United States Patent [19]

Pessina et al.

[11] Patent Number: 4,497,479

[45] Date of Patent: Feb. 5, 1985

[54] DEVICE FOR SYMMETRICALLY OPENING SIGNATURES MADE UP OF SEVERAL SHEETS AND ARRANGING THEM ONTO A TRANSPORT SADDLE

[76] Inventors: Giorgio Pessina; Aldo Perobelli, both of Via Arborina 2, Paderno Dugnano (Milano), Italy, 20037

[21] Appl. No.: 395,282

[22] Filed: Jul. 6, 1982

[30] Foreign Application Priority Data

Jul. 3, 1981 [IT] Italy ..... 22749 A/81

[51] Int. Cl.[3] ..... B65H 39/02

[52] U.S. Cl. ..... 270/54

[58] Field of Search ..... 270/54-57, 270/58; 198/644

[56] References Cited

U.S. PATENT DOCUMENTS

| | | | |
|---|---|---|---|
| 2,025,527 | 12/1935 | Schramm | 270/55 |
| 2,791,421 | 5/1957 | Schramm | 270/54 |
| 2,817,513 | 12/1957 | Bell et al. | 270/54 |
| 3,650,524 | 3/1972 | Hepp | 270/54 |
| 3,661,379 | 5/1972 | Dulfini | 270/54 |
| 3,717,337 | 2/1973 | McCain et al. | 270/54 X |
| 4,162,066 | 7/1979 | McCain et al. | 270/54 |
| 4,177,979 | 12/1979 | Orsinger | 270/54 |

FOREIGN PATENT DOCUMENTS

| | | | |
|---|---|---|---|
| 2436084 | 2/1976 | Fed. Rep. of Germany | 270/54 |
| 403811 | 6/1966 | Switzerland | 270/57 |
| 502314 | 3/1939 | United Kingdom | 270/54 |

*Primary Examiner*—E. H. Eickholt

*Attorney, Agent, or Firm*—Bucknam and Archer

[57] ABSTRACT

A device for symmetrically opening signatures made up of several sheets and arranging them onto a transport saddle, comprising a signature feeder having signature gripping means and signature opening means, in which device for opening signatures a substantially vertical guide length is provided. Associated therewith, symmetrically on either sides, are the means for opening the signature.

2 Claims, 8 Drawing Figures

DEVICE FOR SYMMETRICALLY OPENING SIGNATURES MADE UP OF SEVERAL SHEETS AND ARRANGING THEM ONTO A TRANSPORT SADDLE

BACKGROUND OF THE INVENTION

This invention relates to a device for symmetrically opening signatures made up of several sheets and arranging them onto a transport saddle. Devices of this kind are also termed "feeders".

Devices of the general type indicated above are known per se, e.g. from German Pat. No. 1,945,501 and German Patent Publication DE-OS No. 26 31 063.

The first-mentioned device comprises a conveyor which brings in the signatures with their spines lying downstream relatively to the transport direction, and rotatable suction cups, or sets of suction cups, which are spaced apart from one another and act on the signature sheets, said device being characterized in that the conveyor is in the form of a conveyor belt which has a horizontal, or slightly inclined, length moving under the suction cups, or sets of suction cups, and includes grippers arranged to act on the signature spines and hold the free edge of the lower half of an open, or parted, signature. Furthermore, the suction cups, or sets of suction cups, cooperate with barriers of photoelectric light for controlling the suction cups, or sets of suction cups.

A main disadvantage of the prior device briefly described above is that the device itself, being provided with a horizontal, or substantially so, working length for opening the signatures, involves a fairly long construction. As is known, in printing, bookbinding, and the like shops, the available space is always at a premium. Moreover, the above-described device requires a wall-mounted element for holding one half of the signature open at the transition area from the front surface to an inclined surface for returning and loading onto the saddle, said element frequently resulting in the signature half being open with a fairly small radius of partition, whereby said signature, when laid onto the saddle, tends to hold the sheets of the folded signature half open.

In the solution proposed by the cited DE-OS No. 26 31 063, for transporting the signatures, the use of a drum, made up of disk-like elements laid side by side, is provided on the exterior of which drum suction cups, or sets of suction cups, are arranged which are rotatable and spaced mutually apart, their rotation centers lying on an external circumference with respect to the drum. So far, besides replacing the working or signature-opening length, which is substantially horizontal in the cited German patent, with a circular working length, that is with a portion of the circumference of said drum, no additional feature can be identified. From FIG. 1, moreover, which illustrates the feeding of signatures from a stack placed under the drum, it is not clear how the wall-mounted element 14 which prevents the signature sheets from opening by gravity can, in fact, prevent such opening or parting movement, for instance with thin or low substance sheets. In addition, in FIG. 6, an arrangement of suction cups, or sets of suction cups, may be seen which are mutually spaced apart with their axes lying on a circumference inside the drum. In view of the disk form of construction of the drum, it is not clear how the sheets of the half signature laid onto the drum can be opened, since the opening or parting action appears to be hindered by the presence of the drum internal disks. Anyhow this solution, even when limited to opening the sheets of the outer signature halves, has the disadvantage of requiring drums of large diameter, if the height of the signatures usually handled and the increased height that such signatures may have are taken into account.

This solution of providing the signature magazine located below the drum, is extremely inconvenient for the operator.

SUMMARY OF THE INVENTION

This invention sets out to provide a device of the type specified in the preamble, which while utilizing means partly known per se, can obviate the drawbacks and deficiencies of conventional design devices.

In particular, the device according to the invention has a length dimension or overall size which is fairly compact.

In addition, the device enables the installation of signature opening groups where required in the instance of signatures having many sheets, without the machine length having to be altered.

The device according to the invention, moreover, allows the signatures, or both halves thereof, to be opened completely.

Taking the steps from a device for symmetrically opening signatures made up of several sheets and arranging them onto a transport saddle, which device comprises a signature feeder having signature holding or gripping means and signature opening means of the suction cup type or vacuum-operated type, this invention achieves its objects in that the proposed device is characterized by the provision of a signature feeder comprising a signature opening length or section arranged to extend in a substantially vertical direction, with said length or section of the signature feeder there being associated, on either sides thereof and in a symmetrical fashion, a plurality of signature opening means.

With the inventive device, it becomes advantageously possible to achieve symmetrical opening of the signatures to be placed on the transport saddle, while keeping the device length dimension extremely compact. Of course, through the intermediary of a suitable control of the opening means, it will also be possible to open signatures having different numbers of sheets in their two halves.

The solution proposed herein also affords the advantage that signatures formed from any type of paper and having a size as big as the largest size that can be handled automatically, can be processed in a perfectly satisfactory manner.

Moreover,the proposed device is of simple construction, and requires no specific components for guiding the open signatures.

BRIEF DESCRIPTION OF THE DRAWINGS

Further features, details and advantages of the device according to this invention will be apparent from the following description, with reference to the accompanying illustrative drawings, where.

DESCRIPTION OF PREFERRED EMBODIMENTS

Figure 3:
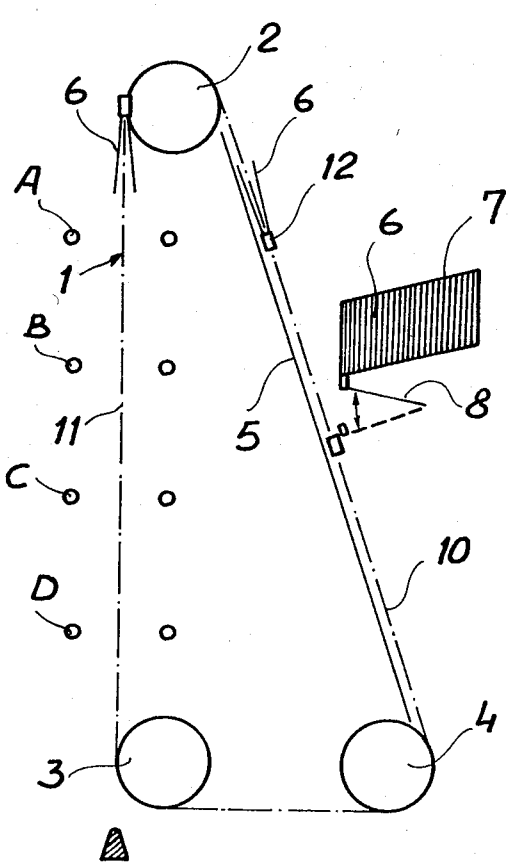
FIGS. 1,2 and 3, show schematically embodiments of the device according to the invention.
Figure 2:
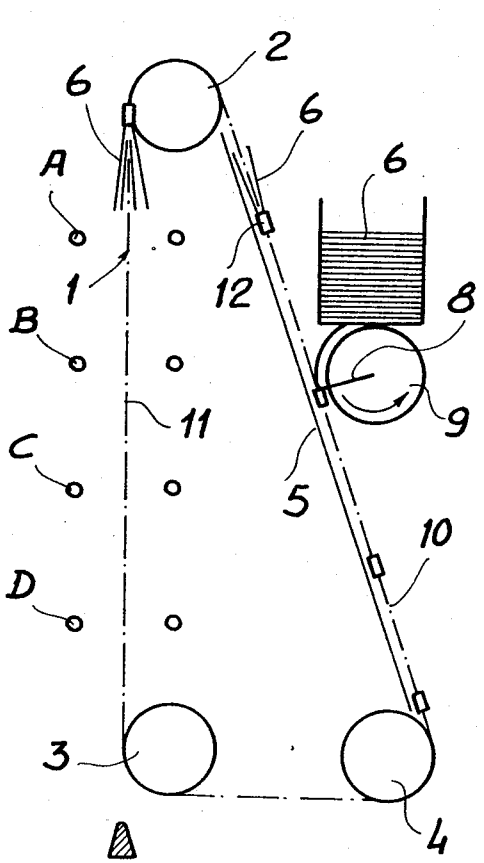
Figure 1:
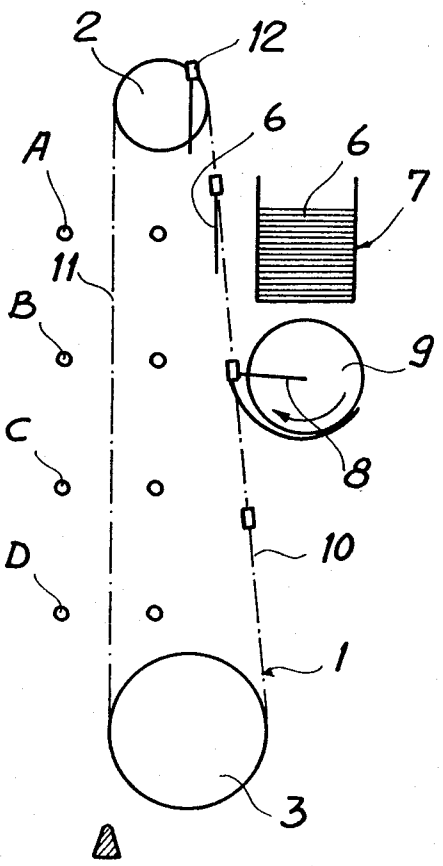

The device according to this invention is a closed loop design of the double chain type, the latter being indicated at 1. The reference numerals 2 and 3 in FIG. 1 and 2,3 and 4 in FIGS. 2 and 3 designate transmission wheels, at least one of which is connected to a drive for setting the chains 1 into motion. Indicated at 5 in FIGS. 2 and 3 is a sheet, or supporting surface, located between the two parallel chains and serving to support the free ends of the signatures, indicated at 6. Said sheet is obviously unnecessary in FIG. 1, which illustrates a preferred embodiment of the invention. The magazine, or loader, for the signatures is indicated at 7, the gripping element for transferring the signatures 6 onto the chains 1 being indicated at 8. The gripping element, in the exemplary embodiment of FIG. 1, is mounted on a feeder disk 9 similarly to FIG. 2, the difference between said Figures residing in that in FIG. 1 the signatures are transported upwards along the oblique side 10 of the triangle by means of gripping elements 12 provided on the chains 1, which upon reaching the proximities of the upper transmission wheel 2 become free to swing so that the signatures 6, gripped with their spine fold facing up in FIG. 1 are then caused to remain with their gripped side up during the downward movement of the signatures along the upright length or section indicated at 11, during which movement the signatures 6 are opened symmetrically. FIG. 2 differs from FIG. 1 in that the signatures 6 are gripped on the chains 1 with their spine fold facing down. In FIG. 3, by contrast, the element for picking up the signatures 6 is indicated at 8, and has a tilting type of operation, also in this case the signatures 6 being gripped on the chains 1 with their folded side downwards.

Figures 4A, 4B, 4C, 4D, 4E:
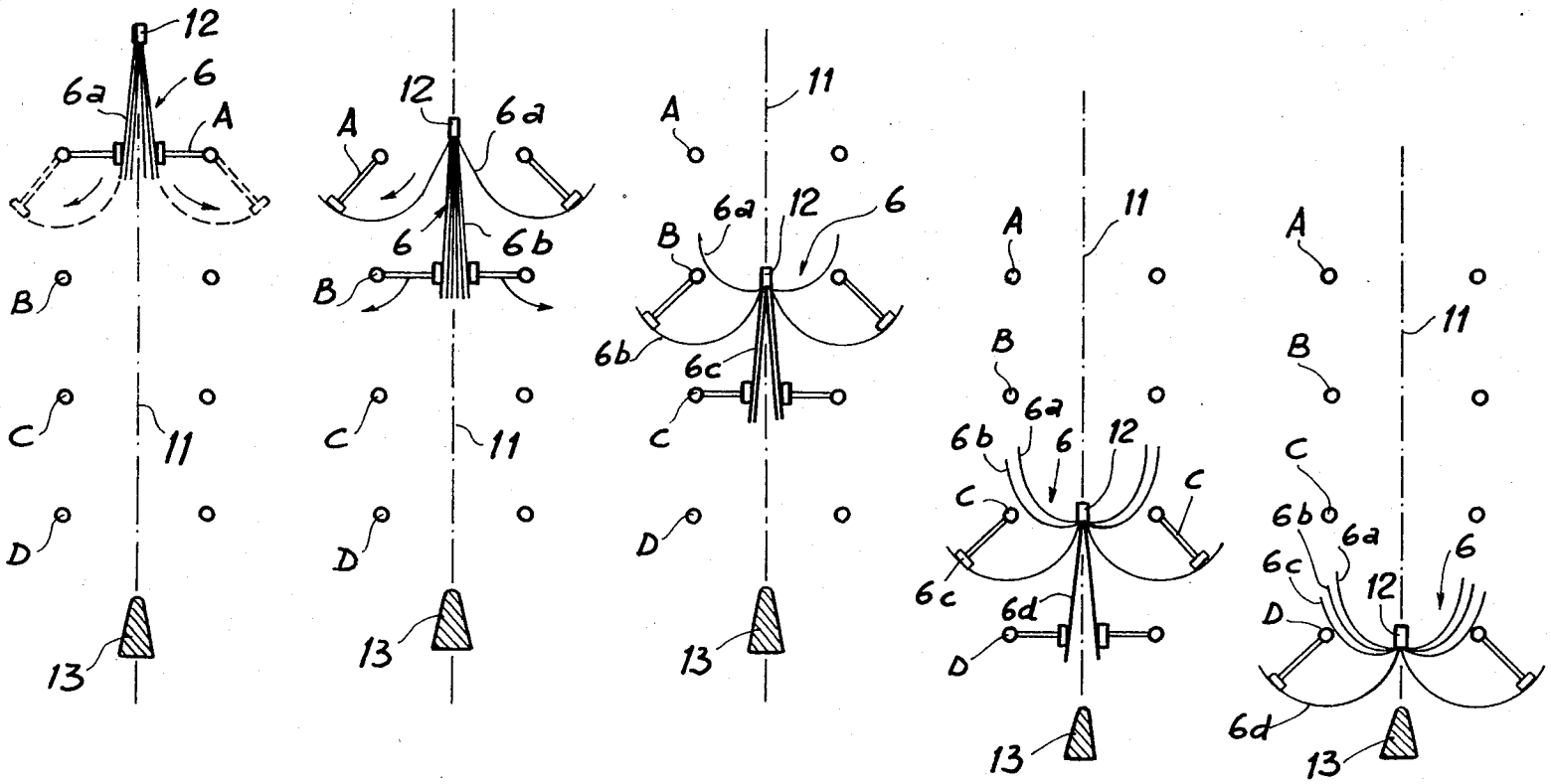
FIGS. 4*a*,4*b*,4*c*,4*d* and 4*e* illustrate the operating principle for opening a signature having, in the embodiment shown, four sheets in each signature half.

The signature opening steps are sequentially represented in FIGS. 4*a*–4*e*. During the first step (FIG. 4*a*) the outermost sheets 6*a* of the signatures are gripped, and specifically at their lower edges or edges opposed to the gripping means 12 provided on the link studs of the chains 1. As the chains 1 move onwards, the gripping means 12 reach the position of FIG. 4*b*, whereat the outer sheet 6*a* is bent outwardly by the first set of suction cups, indicated at A. With the gripping means 12 brought into the position of FIG. 4*b*, the first set of suction cups A has now turned outwards the first outer sheets 6*a* of the signature 6 while the second set of suction cups B just engages the lower edges of the second sheets 6*b* of the signature 6. In the position of FIG. 4*c*, the second set of suction cups B is spreading outwards the second sheets 6*b*, while the suction cups of the third set C engage with the lower edges of the third sheets 6*c* of the signature 6. During the following step as shown in FIG. 4*d*, the gripping means 12 have been moved further down and the suction cups of the set C are turning outwards the third sheets 6*c* of the signature 6, while the suction cup set D engage with the lower edges of the fourth sheets 6*d*, that is, in the embodiment shown, the innermost sheets in the signature 6. During the final step, FIG. 4*e*, the gripping means 12 have moved further down and the suction cups in the set D turn outwards the inner sheets 6*d* of the signature 6, thereby the latter is opened in a symmetrical and complete fashion and is allowed to exactly drop by gravity onto the saddle 13, which is well known in the art. As for the retention of the sheets opened previously during the various steps in the outwardly bent condition, locating rods or the like may be provided, which are known in the art and not further described. However, no wall-mounted elements are utilized for continuously positioning the open sheets of the signatures.

As may be gathered from the drawings, the space requirements for the effectuation of the various signature opening steps are limited substantially to just the vertical run 11 of the chains in the loop 1, thereby the machine may be very compact in length, and hence in overall size.

As for feeding the signatures 6 onto the chains, the embodiments shown should be taken as merely illustrative and in no way restrictive, since it would also be possible to provide the signature stack above the top, possibly driving, transmission pulley 2.

In order to handle signatures of any heights, the suction cup sets A–D may be advantageously arranged to be movable onto a supporting frame, perhaps similarly to the sheet positioning rods or detents shown, which means being well known in the art in a variety of embodiments are not further illustrated herein.

In actual practice, each device according to the invention will include a number of suction cup sets, the cups being provided either singly or plurally in each set, in a corresponding number to the number of the sheets to be opened from the individual signatures being handled.

The opening movement shown is arranged to be symmetrical for either signature halves, but if necessary, it will be possible to just operate those suction cups, or sets of suction cups, which are each time required to open the various sheets, optionally in different numbers, provided in the two signature halves.

The operation of the inventive device for opening, preferably in a symmetrical fashion, signatures including several sheets and arranging them onto a transport saddle, may be readily inferred from the foregoing description.

Furthermore, the extremely simple construction of the device according to the invention should be emphasized, as should its versatility and the significant shortening of its length dimension brought about by the teachings of the invention.

All of the individual parts may be replaced with other technically or functionally equivalent ones, without departing from the invention scope.

Thus, for example, the rotating suction cups may be replaced with tilting suction cups, or with reciprocating linear motion suction cups, or any other desired gripping devices.

The number of the suction cup sets, or any other suitable means for progressively opening the signatures, and the arrangement and types of the opening means, may also be selected as desired, again without departing from the scope of the instant invention.

All of the characteristics that may be inferred from the specification, claims, and drawings, are regarded as substantial to the invention, both individually and in any desired combination thereof.

We claim:

1. A device for symmetrically opening signatures made up of several sheets and arranging them onto a transport saddle, the device including a signature feeder provided with signature holding or gripping means, as well as signature opening means of the suction cup or vacuum-operated type, characterized in that said signature feeder comprises a signature opening length or section arranged to extend in a substantially vertical direction, with said length or section of the signature feeder there being associated, on either sides thereof and in a symmetrical fashion, a plurality of signature opening means, and characterized in that said signature feeder comprises two parallel chains provided with link studs adapted for supporting, or gripping the signatures.

2. A device for symmetrically opening signatures made up of several sheets and arranging them onto a transport saddle, the device including a signature feeder provided with signature holding or gripping means, as well as signature opening means of the suction cup or vacuum-operated type, characterized in that said signature feeder comprises a signature opening length or section arranged to extend in a substantially vertical direction, with said length or section of the signature feeder there being associated, on either sides thereof and in a symmetrical fashion, a plurality of signature opening means, and wherein said signature feeder comprises a single chain with link studs for supporting and gripping the signatures arranged to protrude out of said chain in cantilever-fashion.

* * * * *